US006179255B1

(12) United States Patent
Radford

(10) Patent No.: US 6,179,255 B1
(45) Date of Patent: Jan. 30, 2001

(54) SEAT MOUNTING ASSEMBLY

(76) Inventor: John W. Radford, 30 Alladin Cir. NW., Buffalo, MN (US) 55313

( * ) Notice: Under 35 U.S.C. 154(b), the term of this patent shall be extended for 0 days.

(21) Appl. No.: 09/359,454

(22) Filed: Jul. 22, 1999

(51) Int. Cl.[7] ..... F16M 11/00

(52) U.S. Cl. ..... 248/161; 248/422; 248/420; 248/414; 248/415; 114/194; 297/344.21; 297/344.26

(58) Field of Search ..... 248/161, 422, 248/420, 414, 415, 421; 114/194, 363; 297/344.21, 344.18, 344.26

(56) References Cited

U.S. PATENT DOCUMENTS 3,583,759 6/1971 Radford .
3,789,444 * 2/1974 McCord ..... 297/349 X
4,709,649 * 12/1987 Wann ..... 114/363
5,639,059 * 6/1997 Nash ..... 248/157 X
5,992,804 * 11/1999 Johnson ..... 248/188.9 X
6,042,093 * 3/2000 Garelick ..... 114/363 X

* cited by examiner

*Primary Examiner*—Ramon O. Ramirez
*Assistant Examiner*—A. Joseph Wujciak
(74) *Attorney, Agent, or Firm*—Anthony G. Eggink

(57) ABSTRACT

A seat mounting assembly to rotate a seat in a segment of an inclined rotational plane. The assembly rotates at a predetermined angle with respect to the direction of the force of gravity to bank the seat upward as it traverses to either the left or the right. The seat mounting assembly is constructed and arranged to receive a seat and to be mounted in a vehicle, such as a boat. An anti-rotational assembly is provided to control the rotational speed and the segment within the rotational plane in which the assembly reciprocates.

27 Claims, 5 Drawing Sheets

SEAT MOUNTING ASSEMBLY

BACKGROUND OF THE INVENTION

This invention relates to a seat mounting assembly and more particularly to a mounting assembly for a boat seat which rotates in response to lateral or side to side forces resulting from rocking and movement of a boat, for example. The seat mounting assembly of this invention is suited for various vehicles and environments where a seat is subject to lateral, rocking movement causing the occupant to adjust position to compensate on a stationary seat. Varying boat motion results from buffeting by rough water, waves, or swells or by the turning of the boat while other vehicles encounter similar lateral and vertical motion causing the occupant to react and adjust position.

Boat and other vehicle seats typically do not accommodate lateral or side to side forces which are commonly encountered in boat operation and although rotating seats are known, they are limited in dealing fully with the range of movements encountered by a boat in rough water, for example. There is a need for a seat mounting assembly to effectively deal with lateral and vertical forces in vehicles such as boats.

It is an object of this invention to provide a seat mounting assembly which rotates from side to side to accommodate lateral forces that are encountered during boat operation, for example. The seat mounting assembly of this invention provides an efficient and effective assembly which does not impede the normal operation of the seat and which is usable on standard seat pedestals and seat mounting structures.

Another objective of the seat mounting assembly of the present invention is to provide a boat seat to reduce the discomfort of occupants attempting to maintain a normal seating position against the disruptive forces imposed during boat operation. The axis of rotation of the seat assembly permits the upper body and feet of the occupant to remain relatively stationary as the lower body rotates in a segment.

The seat mounting assembly further provides a seat motion that is dampened by an anti-rotation means which provides comfort and security while encountering rough waters. Another objective of the present invention is to provide a seat mounting assembly which is constructed and arranged to receive a boat seat which does not affect normal seat adjustment, i.e., forward and rear movement to adjust for the height and weight of the occupant. Another object of the invention is to provide an assembly that rotates in a segment of an inclined rotational plane and which has adjustable shock absorbers to dampen seat movement.

SUMMARY OF THE INVENTION

The seat mounting assembly of the present invention relates to seat structures constructed and arranged to accommodate various lateral and vertical forces and force components. Although the seat mounting assembly of the invention is discussed with respect to a boat seat, the assembly may also be used in other environments where lateral forces act on a vehicle, or the like, such as where lateral forces act on the occupant of a tractor or like equipment. For example, a tractor traveling along a hill or through a ditch will experience forces disruptive to the seat occupant, however, utilizing the present invention the occupant remains relatively level and stable. The seat mounting assembly of this invention is for use with seats typically installed in boats, such as those used in sailboats and power boats, for example.

The seat mounting assembly of this invention is comprised of a rotation assembly that is constructed and arranged to be attached between a seat and a base member, having the rotation assembly operative at a predetermined angle when mounted. The seat mounting assembly described and shown is comprised of a rotation assembly having an upper arm and a lower arm connected to and extending therefrom. The upper and lower arms are connected at their respective front ends to the rotation assembly which is constructed to rotate at a selected angle in an angle range. The upper arm is constructed to receive a seat and the lower arm is constructed to be mounted to a pedestal or other mounting structure. The rotation assembly causes the top arm to rotate with respect to the bottom arm. An anti-rotation means is provided to dampen the rotating motion and is provided with adjustment means to control the dampening effect.

As the seat, the upper arm, and seat mounting member rotate with respect to the lower arm, the upper arm and seat move from side to side and upwardly. This reciprocating motion in an angled rotational plane is the result of the rotation assembly being disposed at an angle, for example, and the angle may vary depending upon the use and position of the assembly. The motion provided by the seat mounting assembly allows the occupant's body to be centered on the seat and not forced off the seat by centrifugal forces. The anti-rotation means allows the rotation of the seat to be dampened to control the speed of the rotational movement and to accommodate the weight of the occupant.

These and other benefits of this invention will become clear from the following description by reference to the drawings.

DESCRIPTION OF THE DRAWING FIGURES

Figure 1:
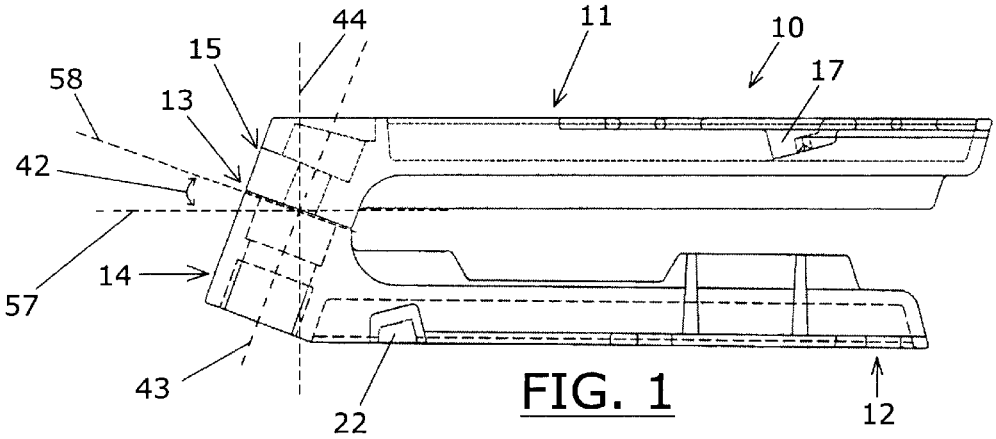
FIG. 1 is a side elevational view of the seat mounting assembly of the present assembly.
Figure 2:
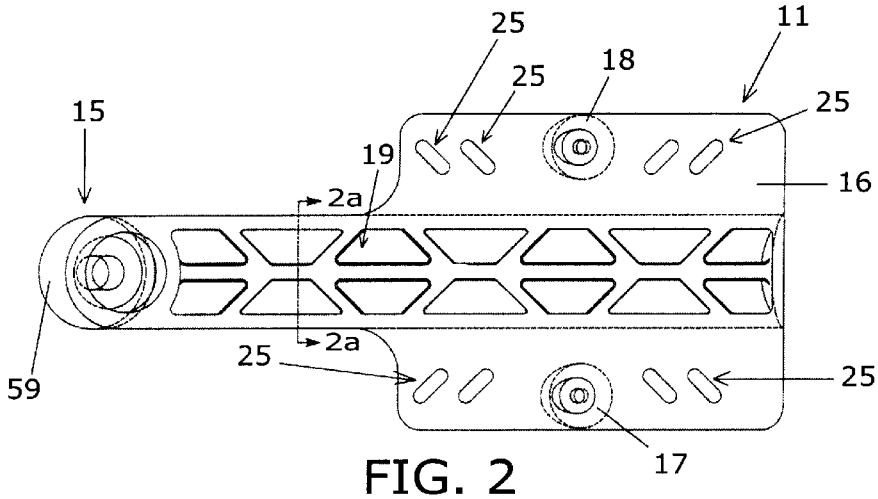
FIG. 2 is a top plan view of the upper arm of the seat mounting assembly.
Figure 3:
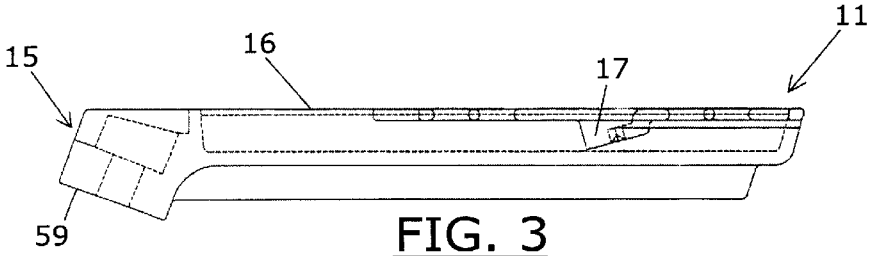
Figure 4:
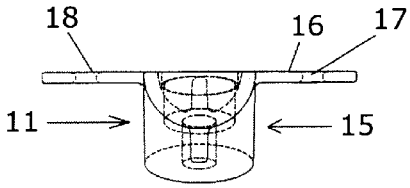
Figure 2A:
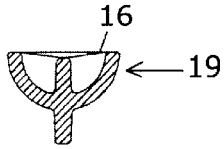
Figure 5:
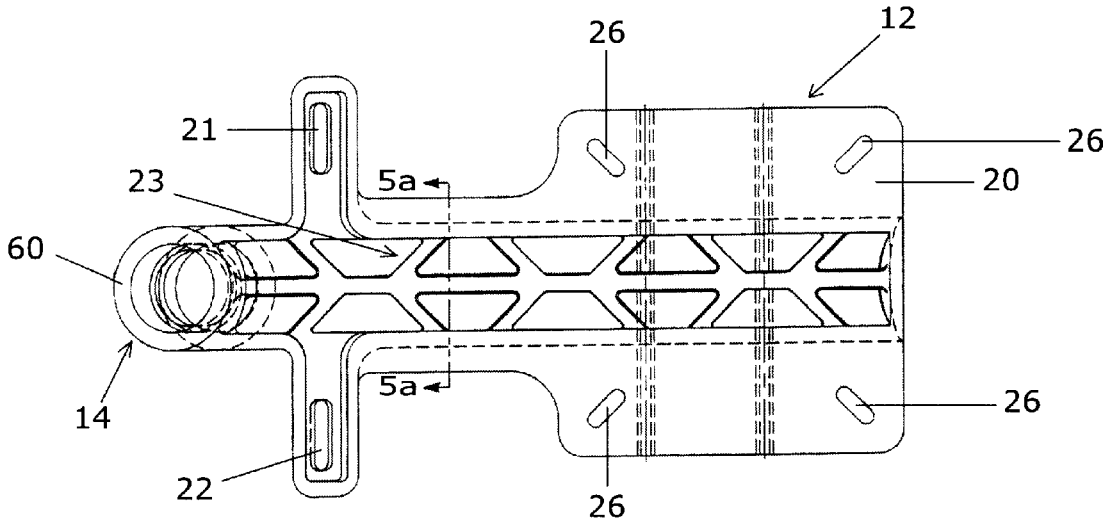
Figure 6:
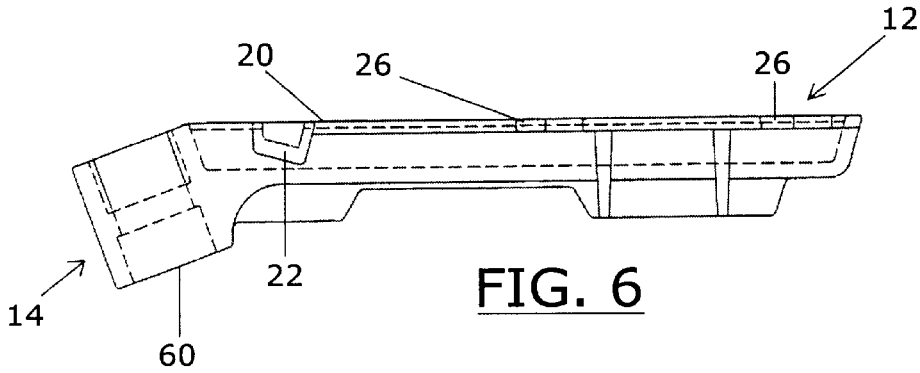
Figure 7:
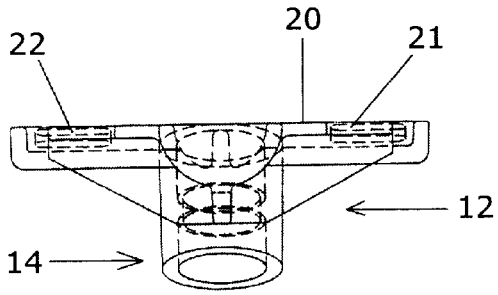
Figure 5A:
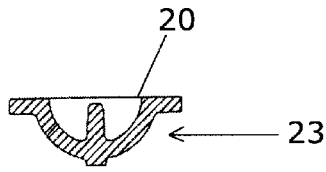
Figure 8:
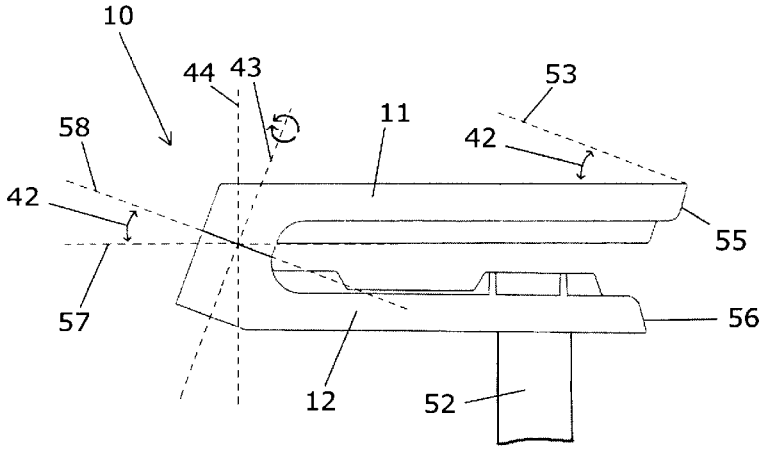
Figure 9:
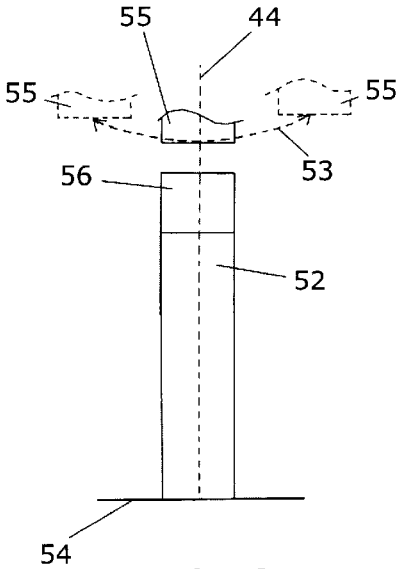
Figure 10:
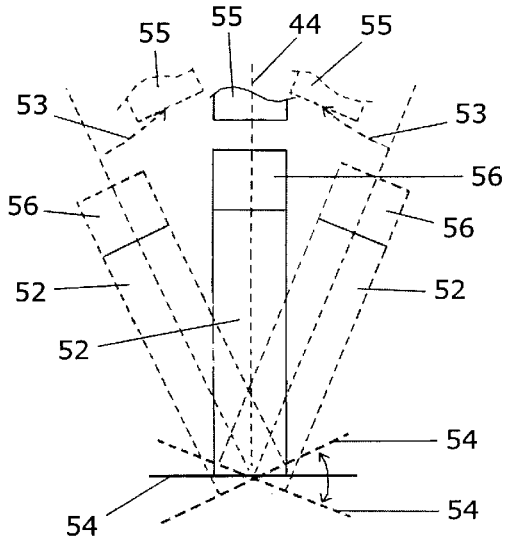
Figure 11:
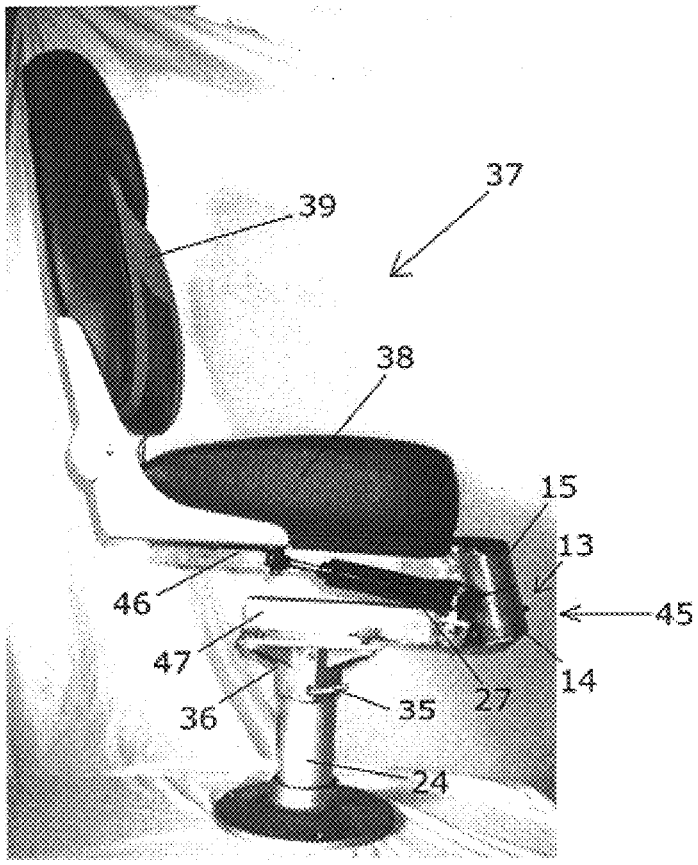
Figure 12:
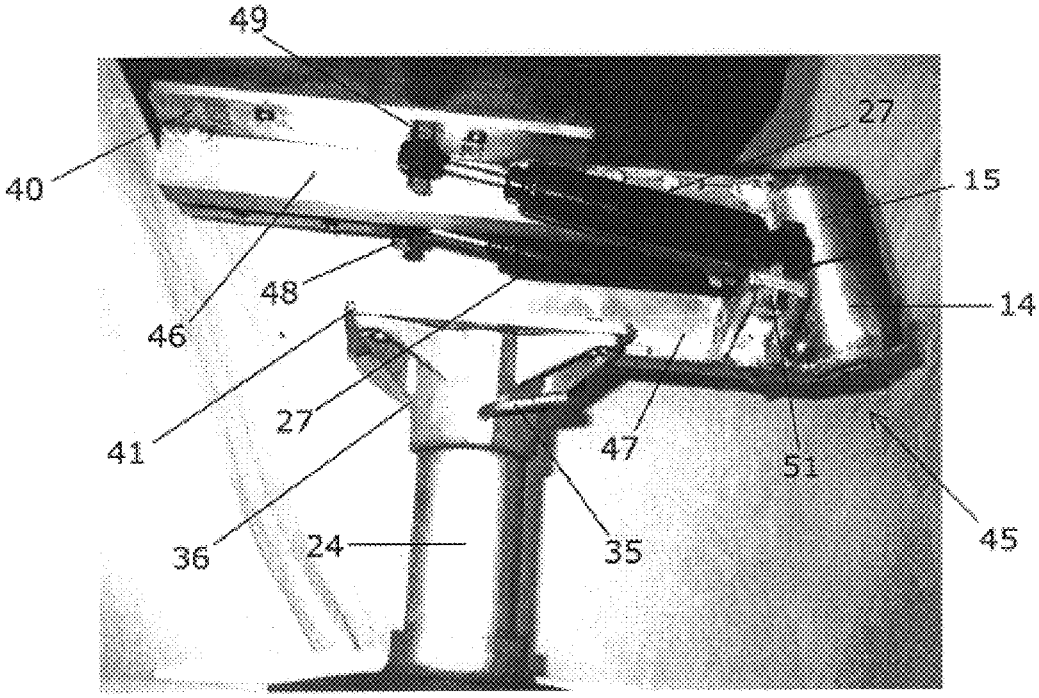
Figure 13:
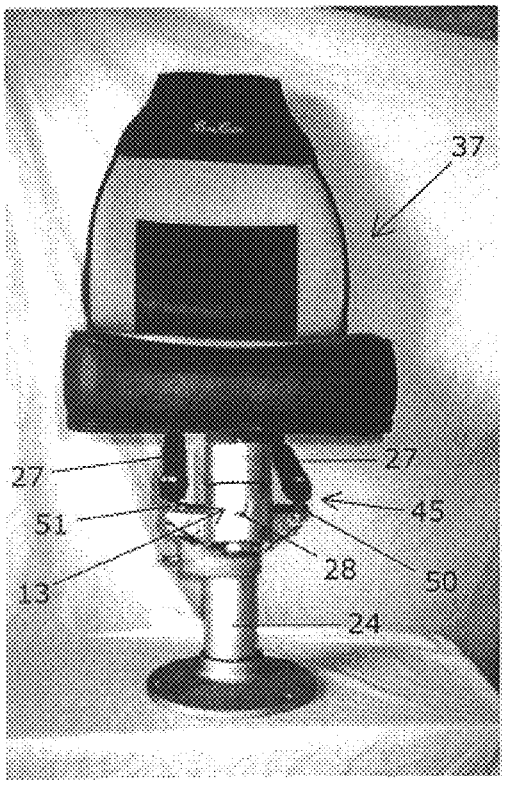
Figure 14:
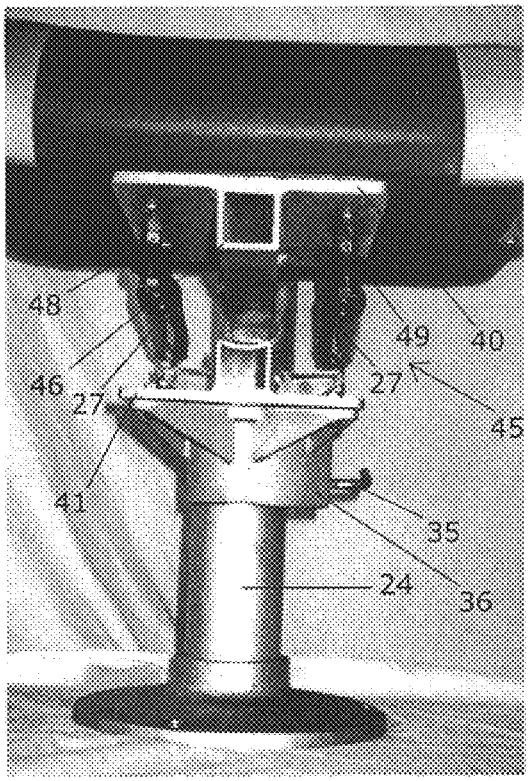
Figure 15:
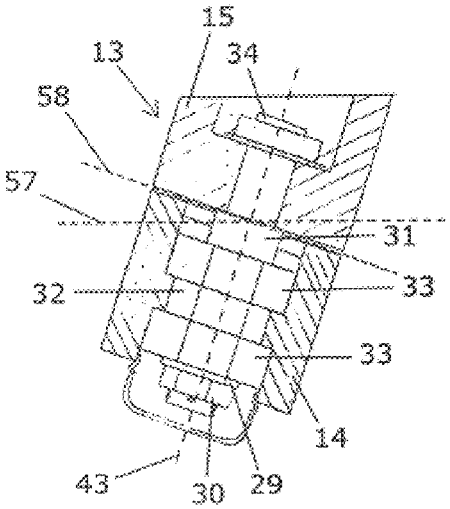
Figure 16:
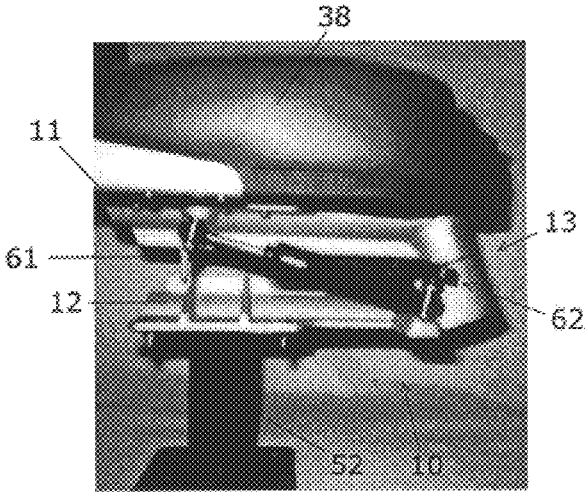

FIG. 2*a* is a sectional view taken along line 2*a*—2*a* of FIG. 2;

FIG. 3*a* is a lateral elevational view of the upper arm of FIG. 2;

FIG. 4 is a front elevational view of the upper arm of FIG. 3;

FIG. 5 is a bottom plan view of the lower arm of the seat mounting assembly;

FIG. 5*a* is a sectional view taken along line 5*a*—5*a* of FIG. 5;

FIG. 6 is a lateral elevational view of the lower arm of FIG. 5;

FIG. 7 is a lateral elevational view of the lower arm of FIG. 6;

FIG. 8 is a side elevational view of the seat mounting assembly mounted on a pedestal and showing the motion of the upper arm;

FIG. 9 is an end view of FIG. 8 and showing the reciprocating rotational movement of the seat mounting assembly;

FIG. 10 is an end view of FIG. 8 and showing the reciprocating rotational movement of the seat mounting assembly when in use;

FIG. 11 is a side view of an alternative embodiment of the seat mounting assembly and showing the invention having a seat and mounted on a pedestal;

FIG. 12 is a perspective side view showing the embodiment of FIG. 11;

FIG. 13 is a frontal perspective view of the embodiment of FIG. 11;

FIG. 14 is a rear perspective view of the embodiment of FIG. 11;

FIG. 15 is a sectional view showing a rotation assembly used in the seat mounting assembly of the invention; and FIG. 16 is a side view of the embodiment of FIG. 1 and showing the invention having a seat and mounted on a pedestal.

DESCRIPTION OF THE PREFERRED EMBODIMENTS

The seat mounting structure of the invention is shown and described with respect to a boat seat, however, it is within the purview of this invention to utilize the seat mounting structure for seats in other vehicles. Seats in various environments are subjected to lateral forces and movement causing occupant movement with respect to the seat. For example, vehicles similar to boats are often subjected to rocking, lateral type movements causing the occupant to shift position to accommodate the force. Tractors traveling along the side of a hill or in a ditch, for example, experience such movements and the present invention permits the occupant to remain relatively level and stable. Seats in various types of vehicles subject to lateral movement may be provided with seat mounting assemblies according to the teachings of the present invention to maintain normal seating positions for occupants subjected to disruptive forces.

The present invention provides an assembly for rotating and banking a seat when subjected to lateral forces. The rotation and banking motions are provided by a rotation assembly having a base member for attachment to a structure of the vehicle and a seat mounting member, on which a seat is mounted, that is attached and rotates with respect to the base member. The rotation assembly is angled with respect to the base member to provide an inclined rotational plane in which the seat traverses. The segment in which the seat traverses or reciprocates within the rotational plane and the rotational speed with which the seat travels is controlled by an anti-rotation means active on the rotation assembly.

Referring to the drawings, FIGS. 1–7 show an embodiment 10 of the seat mounting assembly. The assembly 10 is shown to have an upper arm 11 , a lower arm 12 which is connected for rotation by rotation assembly 13. The rotation assembly is comprised of an upper hub 15 and a lower hub 14 which rotates about axis 43 with respect to each other in plane 58. The upper arm 11 is constructed and arranged to be mounted to a seat and lower arm 12 is constructed and arranged to be mounted to a base member, such as a pedestal, or the like. Upper arm shock absorber mounts 17 and 18 and lower arm shock absorber mounts 21 and 22 are constructed and arranged to receive opposing shock absorbers to dampen and control the reciprocating motion of the upper arm 11 in the inclined rotational plane 58.

Referring to drawings FIGS. 11–14, a boat seat structure is shown having a seat 37 with seat portion 38 and back portion 39 mounted to seat mounting assembly embodiment 45. The seat mounting assembly 45 is shown comprised of an upper arm 46 and a lower arm 47 which are connected for rotation at rotation assembly 13. The rotation assembly 13 has an upper rotation hub 15 and lower rotation hub 14 which are disposed at the ends of upper arm 45 and lower arm 46, respectively. The upper arm 46 and lower arm 47 are shown having shock absorbers 27 mounted therebetween on opposing sides. Upper arm shock absorbers 48 and 49 and lower arm shock absorbers 50 and 51 are constructed and arranged to receive shock absorbers 27. The lower arm 47 is further shown being attached to pedestal 24 by means of mounting bracket 36.

Both seat mounting assembly embodiments 10 and 45 function similarly as shown in FIGS. 8–10. The rotation assembly 13 which may be utilized in each embodiment is shown in FIG. 15, however, it is within the purview of the invention to utilize other rotating means and structures which provide the motion of the present invention.

Referring to FIG. 1, seat mounting assembly 10 is shown to have upper arm 11, lower arm 12 and rotation assembly 13. Rotation assembly 13 has upper rotation hub 15 and lower rotation hub 14 which permit upper arm 11 to rotate with respect to lower arm 12. Shock absorber mounts 17 and 22 are located on upper arm 11 and lower arm 12, respectively. Upper arm shock absorber mount 17 and lower arm shock absorber mount 22 are shown and permit attachment of a shock absorber which restricts the rotational movement of upper arm 11. Upper arm 11 rotates with respect to lower arm 12 around axis 43 and along plane 58. Axis of rotation 43 is defined as an axis which is angled with respect to the force of gravity 44 and plane of rotation 58 is defined as a plane which is angled with respect to a plane 57 which is normal or perpendicular to the force of gravity 44. Axis and plane of rotation 43 and 58, respectively, are shown angled by angle 42, which is shown as approximately 20° and is preferably an angle in a range of 0–90°. Angle 42 may be varied depending on the distance between the seat and floor with which the assembly is used. For example, a longer distance would permit the use of a larger angle and a shorter distance would permit the use of a smaller angle.

FIGS. 2 and 3 show upper arm 11 of seat mounting assembly embodiment 10 comprised of upper rotation hub 15, opposing shock absorber mounts 17 and 18, support ribs 19 and seat mount apertures 25. Upper arm 11 is shown to be a unitary structure constructed and arranged having top portion 16 with seat mounting apertures 25 to mount a seat thereon. Shock absorber mounts 17 and 18 are constructed and arranged to receive opposing shock absorbers. Face 59 of upper rotation hub 15 is shown and defines the angle 42 about which the assembly operates, as shown on FIG. 1. FIG. 2*a* further shows support ribs 19 and top portion 16 along line 2*a*—2*a* of FIG. 2. FIG. 4 shows the front of upper arm 11 and upper rotation hub 15. Top portion 16 is shown containing shock absorber mounts 17 and 18.

Referring to FIGS. 5 and 6, lower arm 12 is shown having lower rotation hub 14, shock absorber mounts 21 and 22, support ribs 23 and pedestal mount apertures 26. Lower arm 12 is shown to be a unitary structure and is constructed and arranged to be attached to a pedestal or the like. The bottom portion 20 of lower arm 12 contains pedestal mount apertures 26. Shock absorber mounts 21 and 22 are constructed and arranged to cooperate with mounts 18 and 17 of the upper arm 11 of FIGS. 2–4 by connecting opposing shock absorbers therebetween. Face 60 is shown defining the angle 42 as shown in FIG. 1. Support ribs 23 and bottom portion 20 are further shown in FIG. 5*a*. FIG. 7 shows a rear view of lower arm 12 and lower rotation assembly 14. Shock absorber mounts 21 and 22 are shown behind lower portion 20.

FIGS. 8–10 show the seat mounting assembly 10, and further show the rotational movement of the assembly as it is subjected to outside forces, particularly, lateral forces and lateral force components resulting from rocking or side to side movement experienced in boat movement, for example. As shown, the lower arm 12 of the assembly 10 is mounted to a pedestal 52 fixed to the bottom 54 of a boat. As previously described, the upper arm 11 rotates about axis 43 and along plane 58 as a result of the angle 42 of the connection between the front end of the upper arm 11 to lower arm 12. The angle 42 is measured with respect to a plane 57 which is normal or perpendicular to the force of gravity depicted by 44 when the boat is at rest in calm water. When an occupant is seated in a seat mounted to upper arm 11 above pedestal 52 and the boat and thus bottom 54 is subjected to a lateral force, the rear part 55 of upper arm 11 travels in a rotational plane 53 as depicted in FIGS. 8–10 as the seat rotates about the axis 43. As shown particularly in FIGS. 9 and 10, the rear portion 55 of arm 11 reciprocates in the rotational plane 53 with respect to the rear portion 56 of lower arm 12.

As discussed above, the reciprocating arced path of the seat within a segment of rotational plane 53 is due to the constraints of the opposing anti-rotational means or shock absorbers 27. The distance between the opposing anti-rotational means determines the length of the arced rotational path. For example, positioning the shock absorbers close together would permit the upper arm to rotate approximately 90° on either side of the lower arm. Other means may be used to determine the length of the rotational arc segment, such as rubber bumpers or stops, for example.

Specifically shown in FIG. 10, as the bottom 54 is tilted to the left, the pedestal 52 and rear portion 56 of bottom arm 12 tilt left causing the rear portion 55 of upper arm 11 and the seat to move right in rotational segment 53. An opposite movement to the right will cause the seat to move about axis 43 to the left. This reciprocating motion in rotational plane 53 results from the angular connection at the rotational hub interconnecting the upper arm 11 and lower arm 12 at their respective front ends.

Referring to FIGS. 11–14, embodiment 45 of a seat mounting assembly is shown. Embodiment 45 is comprised of rotation assembly 13, lower rotation hub 14, upper rotation hub 15, shock absorbers 27, upper arm 46, lower arm 47, seat mounting plate 40 and pedestal mounting plate 41. Unlike the embodiment 10, embodiment 45 is not a unitary structure, instead it is comprised of a plurality of parts which are constructed and arranged to receive a pedestal and a seat and to rotate in a reciprocating motion in an angled plane.

FIGS. 11 and 12 show embodiment 45 attached to a seat 37 and a pedestal 24. However, the assembly may be mounted to other structures, such as a bench, as may embodiment 10. Seat 37 is comprised of seat portion 38 and back portion 39. Rotation assembly 13 is shown comprising upper rotation hub 15 which is on the front end of upper arm 46 and lower rotation hub 14 which is on the front end of lower arm 47. Shock absorber 27 is shown extending from mount 49 to mount 51 to dampen the reciprocating motion by restricting the rotation of upper arm 46 around lower arm 47. An opposing shock absorber 27 can be seen extending from mount 48. As shown in FIGS. 11–14, the shock absorbers 27 are preferably connected generally parallel to mounting arms 46 and 47 and are a distance of approximately 1 ¾" from the respective arms. Seat 37 is attached to assembly 45 by means of seat mounting plate 40 which connects seat portion 38 to upper arm 46. Shock absorber mounts 48 and 49 are contained on seat mounting plate 40. Shock absorber mounts 50 and 51 are shown spaced from lower arm 47. Pedestal 24 is attached to assembly 45 by pedestal mounting plate 41. Pedestal mounting plate 41 is attached to pedestal mounting bracket 36 which is secured to pedestal 24 by mounting bracket locking pin 35. Locking pin 35 allows the seat assembly to be adjusted and secured to suit its occupant.

Referring to FIG. 13, the front of seat mounting assembly 45 is shown attached to boat seat 37 and pedestal 24. Opposing shock absorbers 27 can be seen attached to mounts 50 and 51 of the lower part of the assembly. The front of rotation assembly 13 is shown having locking pin 28. FIG. 14 is a rear view of seat mounting assembly 45. Seat mounting plate 40 is shown attached to upper arm 46 and having mounts 48 and 49 for shock absorbers 27. Pedestal mounting plate 41 is shown attached to mounting bracket 36 which is secured to pedestal 24 by locking pin 35.

The joining of the upper and lower rotation hubs 15 and 14 to form rotation assembly 13 and to provide the motion discussed with respect to the present invention, may be accomplished by any suitable means known in the art. One such means is shown in FIG. 15. As shown, the adjacent surfaces of hubs 15 and 14 are angled with respect to a plane 57 normal the force of gravity. Plane 58 represents the plane of rotation and axis 43 represents the axis of rotation. As shown, the lower rotation hub 14 is internally configured to contain a set of bearings 33, preferably sealed roller bearings, and upper rotation member 14 has an axle shaft 34 which cooperates with the bearings 33. The shaft 34 is preferably constructed of stainless steel or a like material. The lower rotation hub 14 is shown configured to contain two sets of bearings 33 separated by a shoulder 32 and protected by bearing seals 31. A bearing adjusting nut 30 and retainer 29 are shown fastened at the bottom end of the axle shaft 34 and which allows the axle to rotate in the lower rotation hub 14. As shown in FIG. 13, the lower rotation hub 14 may also have a locking pin 28 which may be used to lock the lower rotation hub 14 and the upper rotation hub 15 to prevent rotation if rotation is not desired. Other means to lock the seat mounting assembly to prevent rotation may also be used.

FIG. 16 shows embodiment 10 of the seat mounting assembly in use attached to a seat 38 and being locked to prevent rotation of the assembly. Unitary upper arm 11 is shown being attached to seat portion 38. Unitary lower arm 12 is shown attached to pedestal 52. Adjustment knob 62 is shown on the shock absorber used with embodiment 10. The shock absorbers are preferably hydraulic shock absorbers which provide constant pressure. Adjustment knob 62 permits the front end of the shock absorber to be moved laterally away from the lower arm 12 of the assembly, thereby increasing the pressure and resistance of the shock absorber. Other types of adjustable shock absorbers may also be used to achieve varying resistances and, therefore, varying the pressure and dampening to the rotating assembly. Locking mechanism 61 is shown holding upper arm 12 and lower arm 11 together to prevent rotation. Locking mechanism 61 is a safety mechanism and may be used when a stable seat is desired. For example, when used in a driver's seat in a boat, it is recommended that the seat assembly be locked together when the boat exceeds 5 miles per hour. It is within the purview of the invention to use other means for safety locking the assembly. For example, the locking mechanism may be a pin, such as pin 28 discussed above, or a locking mechanism operative on the shock absorbers.

In summary, the seat mounting assembly is constructed and arranged to receive a seat and permit the occupant of the seat to stay in relatively the same position while the vehicle experiences turbulence. As shown in the drawings, the assembly includes upper arm and lower arm structures which are adapted to reactive a seat and a pedestal or the like and which may be unitary. A rotation assembly is disposed at the respective front ends of the upper and lower arms. The upper and lower parts of the rotation assembly have adjacent surfaces which are angled with respect to a plane normal gravitational force. This angle permits the upper arm to move around the lower arm in a segment of a rotational plane which is angled with respect to a plane normal gravitational force. Anti-rotational forces on either side of the assembly provide for the reciprocating motion of the upper arm about the lower arm and provide control over the speed in which the upper arm moves through the plane of rotation. The arms and the rotation assembly may be constructed from any suitable material known in the art, however, materials such as aluminum, steel, stainless steel, plastic and the like may be utilized. For example, the upper and lower arms of one embodiment, as shown in FIGS. 1–7, preferably have a ribbed aluminum construction. One such embodiment, according to the invention, is constructed and arranged to be approximately 18 inches long, 8.5 inches wide, 5 inches high, weighing approximately 14 pounds and which can be used with a 9 inch in height pedestal.

The shock absorbers which provide the anti-rotational force are preferably adjustable in order to accommodate various weights of occupants. It is within the purview of this invention to vary the angle which defines the adjacent sides of the rotation assembly and thus the rotational plane of motion. For example, in the case of a boat, rougher waters create more displacement of a boat seat. An increased angle would provide a more angled rotational plane to effect larger movements of a boat seat to compensate for the turbulence.

As many changes are possible to the embodiments of this invention utilizing the teachings thereof, the descriptions above and accompanying drawings should be interpreted in the illustrative and not in the limited sense.

That which is claimed is:

1. A seat mounting structure for a rotating seat comprising:

a) an upper member having a forward end and a lower member having a forward end;

b) a rotatable connecting portion joining for rotation said forward end of said upper member and said forward end of said lower member and being constructed and arranged whereby said upper member rotates in a segment of an inclined rotational plane at a specified angle with respect to a plane normal gravitational force when at rest; and c) an anti-rotational force means operative on said rotatable connecting portion and wherein said anti-rotational force means includes at least one adjustable dampening device.

2. The seat mounting structure of claim 1, wherein said connecting portion is a rotatable hub having an upper hub portion disposed at said forward end of said upper member and a lower hub portion disposed at said forward end of said lower member and wherein said rotational plane ranges from 0°–90° with respect to said plane normal gravitational force.

3. The seat mounting structure of claim 2, wherein said rotatable hub comprises at least one set of bearings and a fastening member holding said upper hub portion to said lower hub portion and said seat mounting structure further having means to lock and prevent rotation of said rotatable connecting portion.

4. The seat mounting structure of claim 1, wherein said anti-rotational force means is comprised of opposing shock absorbers mounted between said upper member and said lower member.

5. The seat mounting structure of claim 4, wherein said shock absorbers are adjustable and wherein said rotational segment is approximately 180°.

6. The seat mounting structure of claim 1, wherein said upper member is an upper arm structure extending from said connecting portion and having means to receive a seat.

7. The seat mounting structure of claim 1, wherein said lower member is a lower arm structure having means to connect said seat mounting structure to a pedestal or the like.

8. A mounting structure for a rotatable seat comprising:

a) a base member having an axis of rotation at a predetermined angle with respect thereto;

b) a seat mounting means being connected for rotation to and rotating with respect to said base member about said axis of rotation whereby its movement is in a plane of rotation about said axis of rotation;

c) an anti-rotational force means constructed and arranged to maintain the rotation of said seat mounting means within a segment of said plane of rotation; and d) an angled connecting structure connecting said base member and said mounting means, said angled connecting structure defining said plane of rotation.

9. The mounting structure of claim 8, wherein said anti-rotational force is comprised of opposing shock absorbers, each said shock absorber disposed and extending between said base structure and said mounting means and being positioned on opposite sides of said axis of rotation.

10. The mounting structure of claim 8, wherein said base member comprises a lower arm portion having means to fix said mounting means in a vehicle and wherein said seat mounting means comprises an upper arm portion having means to receive and fix a seat thereto.

11. The mounting structure of claim 8, wherein said connecting structure is a rotatable hub having an angled cross section and wherein said angle ranges from 0–90° with respect to said axis of rotation.

12. The mounting structure of claim 11, wherein said rotational hub comprises a shaft and at least one set of sealed bearings.

13. A seat mounting assembly comprising:

a) a rotation assembly, having means to attach a seat, constructed and arranged to traverse a seat in a segment of an inclined rotational plane, said plane being inclined at a predetermined angle with respect to a plane normal to the direction of the force of gravity when the assembly is at rest, said predetermined angle being in a range between 0 and 90 degrees; and b) an anti-rotational means operative on said rotation assembly.

14. The seat mounting assembly of claim 13, wherein said rotation assembly is comprised of a rotation means, an upper seat mounting member and a lower base member.

15. The seat mounting assembly of claim 13, wherein said means to attach to a seat is comprised of a seat mounting plate.

16. The seat mounting assembly of claim 13, wherein said anti-rotation means is comprised of a plurality of shock absorbers constructed and arranged to control the speed of said traverse and length of said path in said segment of said rotational plane.

17. The seat mounting assembly of claim 13 wherein said segment of said rotational plane is approximately 180°.

18. The seat mounting assembly of claim 13, wherein said rotation assembly is constructed of a rigid material selected from the group of materials comprising plastic, steel, stainless steel, and alumimum.

19. A seat mounting assembly for fixing a rotatable seat to a structure comprising:

a) a base member;

b) a seat mounting member having means for connecting a seat above said base member and a rotatable connection means to said base member, said seat mounting member constructed and arranged to traverse a seat in a path along a segment of an inclined rotational plane, said plane being inclined with respect to a plane normal to the direction of the force of gravity when the structure is at rest, said inclined rotational plane being in an angle range between 0 and 90 degrees; and c) an anti-rotation means extending between said base member and said seat mounting assembly and being operative with respect to said plane of rotation.

20. A seat mounting assembly comprising:

a) a base member having a means to connect said base member to a surface;

b) a seat mounting member having a means to connect said seat mounting member to the bottom surface of a seat and being rotatably connected to said base member to comprise a rotation assembly having a plane of rotation, said plane being tipped at a predetermined angle with respect to a plane normal to the direction of the force of gravity when the structure is at rest, said predetermined angle being in a range between 0 and 90 degrees; and c) an anti-rotation means that provides a biasing force to dampen the rotation of said seat mounting member with respect to said base member.

21. The seat mounting assembly of claim 20, wherein said predetermined angle of said plane of rotation of said rotation assembly is approximately 20 degrees.

22. The seat mounting assembly of claim 20, wherein said means to connect said seat mounting assembly to said seat is comprised of an upper arm having a top portion and a bottom portion, said bottom portion connected to said seat mounting member and said top portion connected to a seat mounting plate.

23. The seat mounting assembly of claim 20, wherein said means to connect said base member to a surface is comprised of a lower arm having top and bottom portions, said top portion connected to said base member and said bottom portion connected to a surface mounting plate.

24. The seat mounting assembly of claim 20, wherein said anti-rotation means is comprised of a plurality of shock absorbers.

25. The seat mounting assembly of claim 20, wherein said anti-rotation means is adjustable to increase or decrease the amount of rotation of said seat mounting member with respect to said base member.

26. The seat mounting assembly of claim 20, wherein said seat mounting assembly further comprises:

a) a boat seat having at least a top and bottom portion, said bottom portion attached to said seat mounting plate; and b) a pedestal having a top end and a bottom end, said top end attached to said pedestal mounting plate and said bottom end constructed and arranged to be attached to the floor of a boat.

27. The seat mounting assembly of claim 20, wherein said base member is constructed and arranged to contain at least a set of bearings and is constructed having an aperture through said base member and wherein said seat mounting member is further comprised of an axle shaft that engages said aperture and is rotatably connected to said base member. p1 b) an anti-rotational means operative on said rotation assembly.

* * * * *